US010736386B1

(12) United States Patent
Hutchins et al.

(10) Patent No.: US 10,736,386 B1
(45) Date of Patent: Aug. 11, 2020

(54) JEWELRY DEVICE WITH INTERCHANGEABLE DECORATIVE PIECE

(71) Applicants: Cody Hutchins, Nashville, TN (US); Jeremy Raley, Nashville, TN (US)

(72) Inventors: Cody Hutchins, Nashville, TN (US); Jeremy Raley, Nashville, TN (US)

( * ) Notice: Subject to any disclaimer, the term of this patent is extended or adjusted under 35 U.S.C. 154(b) by 0 days.

(21) Appl. No.: 16/177,195

(22) Filed: Oct. 31, 2018

Related U.S. Application Data

(60) Provisional application No. 62/583,186, filed on Nov. 8, 2017.

(51) Int. Cl.

| | |
|---|---|
| ***A44C 5/00*** | (2006.01) |
| ***A44C 9/00*** | (2006.01) |
| ***A44C 13/00*** | (2006.01) |
| ***A44C 7/00*** | (2006.01) |
| ***A44C 15/00*** | (2006.01) |

(52) U.S. Cl.
CPC ..... *A44C 13/00* (2013.01); *A44C 5/0053* (2013.01); *A44C 7/002* (2013.01); *A44C 9/00* (2013.01); *A44C 15/005* (2013.01); *A44C 15/0025* (2013.01); *A44C 15/0085* (2013.01)

(58) Field of Classification Search
CPC ..... A44C 5/003; A44C 5/0023; A44C 1/00; A44C 13/00; A44C 7/002; A44C 9/00; A44C 15/0025; A44C 15/005; A44C 15/0085; A44C 9/0084; A44C 5/0007; A44C 9/0092; A44C 5/0053; A44C 5/12; A44C 15/003; A44C 5/00; G09F 3/14; G09F 3/005; A41D 20/00; G04B 37/005; G04B 37/00; A45D 8/36; A45D 8/34; A45D 8/00; A45D 2008/002; A45D 2008/345; Y10T 29/49826; Y10T 24/17
USPC ..... 63/40, 15, 3, 43, 1.11, 1.12, 1.16; 132/275, 276, 273, 333, 278; 248/682; 24/3.2, 30.5 R; D11/3–4; 47/32.5, 41.13, 47/41.14, 41.15, 47; 224/578, 163, 165, 224/166, 173, 267, 269
See application file for complete search history.

(56) References Cited

U.S. PATENT DOCUMENTS

| | | | | |
|---|---|---|---|---|
| 3,610,488 | A * | 10/1971 | Tracy | A44C 5/00 224/171 |
| 4,855,972 | A * | 8/1989 | Eiss | G04B 37/1486 368/282 |
| 2013/0133365 | A1* | 5/2013 | Zannella | A44C 5/003 63/1.11 |

* cited by examiner

*Primary Examiner* — Jack W Lavinder
(74) *Attorney, Agent, or Firm* — Eric B. Fugett; Mark A. Pitchford; Pitchford Fugett, PLLC

(57) ABSTRACT

A wearable jewelry device is a continuous ring shaped base member including an interior side, an exterior side, and a circumferential channel defined in the exterior side, the channel having a depth and extending annularly around a circumference of the exterior side of the base member; and a continuous annular decorative band removably receivable within the channel of the base member. The decorative band has a thickness that is substantially equal to the depth of the channel such that the decorative band is flush with the exterior side of the base member when the decorative band is received within the channel. The base member and the decorative band are formed from a resilient material.

8 Claims, 4 Drawing Sheets

JEWELRY DEVICE WITH INTERCHANGEABLE DECORATIVE PIECE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to wearable jewelry. More particularly, the present disclosure relates to customizable wearable jewelry. Conventional jewelry typically maintains a consistent ornamental or decorative appearance, which cannot be altered, interchanged, or customized. As such, conventional bracelets are sold as a single ornamental design. If a user wants to wear a jewelry piece with a different ornamental appearance, the user would need to purchase an entirely new piece of jewelry. The need to have completely separate pieces of jewelry for different designs and ornamental appearances can require the user to amass a large inventory or supply of different jewelry pieces to suit the user's needs, which is undesirable. Customizable jewelry predominantly consist of pieces of jewelry that include a band with multiple jewels, trinkets, inserts, charms, or other attachments that can be placed along the band of the bracelet. While these attachments can somewhat alter the ornamental look of the bracelet, interchanging the attachments on the band can be cumbersome and difficult, and the attachments themselves can be sizeable, thus making the jewelry awkward to wear.

What is needed then are improvements in the area of wearable jewelry.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a wearable jewelry device including a ring shaped base member including an interior side, an exterior side, and a circumferential channel defined in the exterior side of the ring shaped base member, and a resilient decorative band retainable within the circumferential channel of the ring shaped base member. In some embodiments, the resilient decorative band can be orientable within the ring shape base member such that the two components appear as a single integral piece of jewelry. The resilient decorative band can be removable from the ring shaped base member such that the resilient decorative band can be readily interchanged with the other decorative resilient bands to alter the overall appearance of the wearable jewelry device. Such interchangeability can allow a user to customize the wearable jewelry device to a particular occasion or to the user's liking. In some embodiments, the resilient decorative band can also be reversible such that two designs can be offered in a single resilient band.

Numerous other objects, advantages and features of the present disclosure will be readily apparent to those of skill in the art upon a review of the following drawings and description of a preferred embodiment.

DETAILED DESCRIPTION

Figure 1:
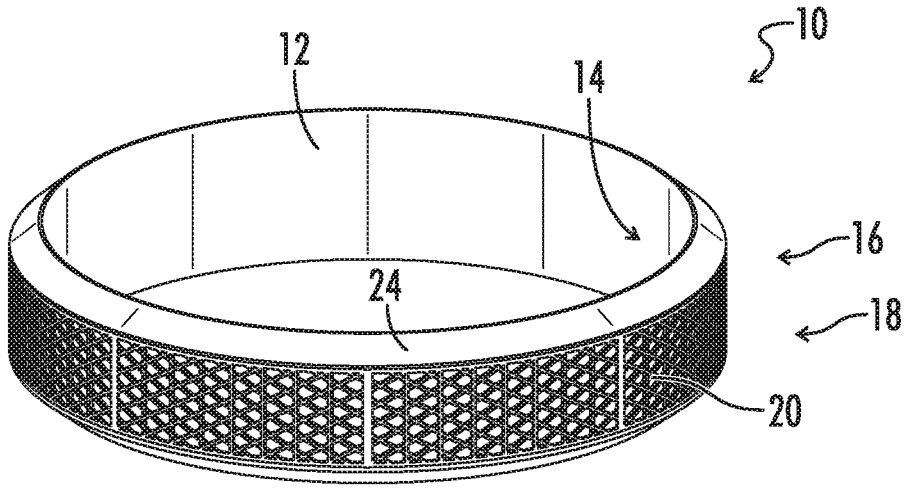
FIG. 1 is a perspective view of an embodiment of a wearable device of the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

Figure 2:
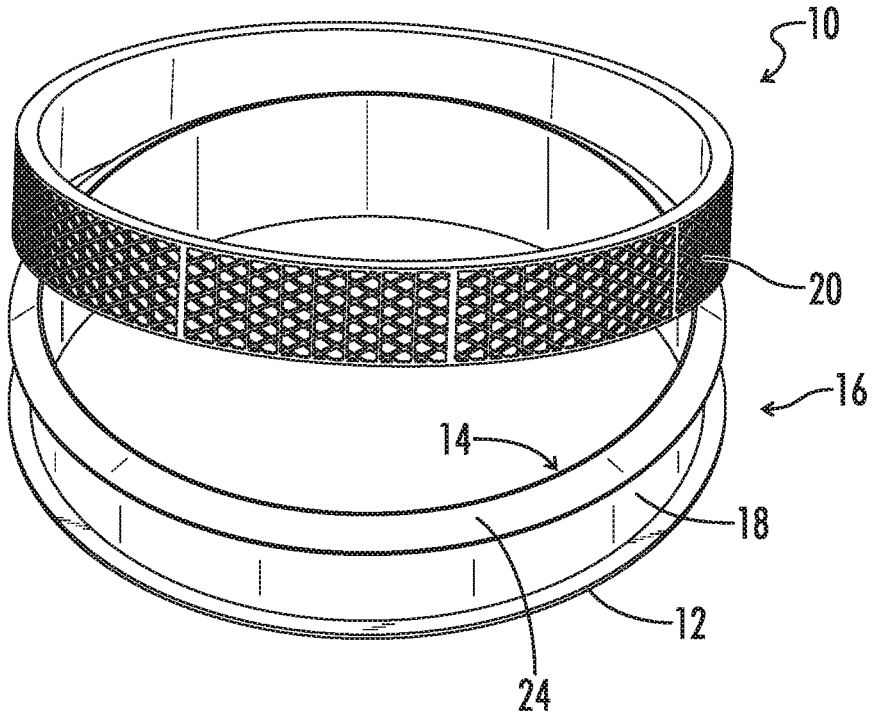
FIG. 2 is a perspective view the device of FIG. 1 with a resilient decorative band removed from a ring shaped base member.

An embodiment of a wearable jewelry device 10 is shown in FIGS. 1-2. The device 10 can include a ring shaped base member 12. The ring shaped base member 12 can include an interior side 14 and an exterior side 16. A circumferential channel 18 can be defined in the exterior side 16 of the ring shaped base member 12. A resilient decorative band 20 can be retainable within the circumferential channel 18 on the ring shaped base member 12. The resilient decorative band 20 can be stretched over the exterior side 16 of the ring shaped base member 12 and positioned in the circumferential channel 18. The resilient decorative band 20 can be sized and configured to be retained within the circumferential channel 18. A user would need to apply a force to the resilient decorative band 20 or the ring shaped base member 12 to deform either the ring shaped base member 12 or the resilient band 20 in order to remove the resilient band 20 from the circumferential channel 18.

In some embodiments, the resilient decorative band 20 can be made from any suitable resilient material, including but not limited to rubber, silicone rubber, elastomeric polymers, or resilient plastics. In some embodiments, the ring shaped base member 12 can also be made from a suitable resilient material, such as rubber, silicone rubber, elastomeric polymers, or resilient plastics. In other embodiments, the ring shaped base member 12 can be made from a more rigid material including but not limited to wood, metal, hard plastic, leather, ceramics, glass, etc.

Figure 3:
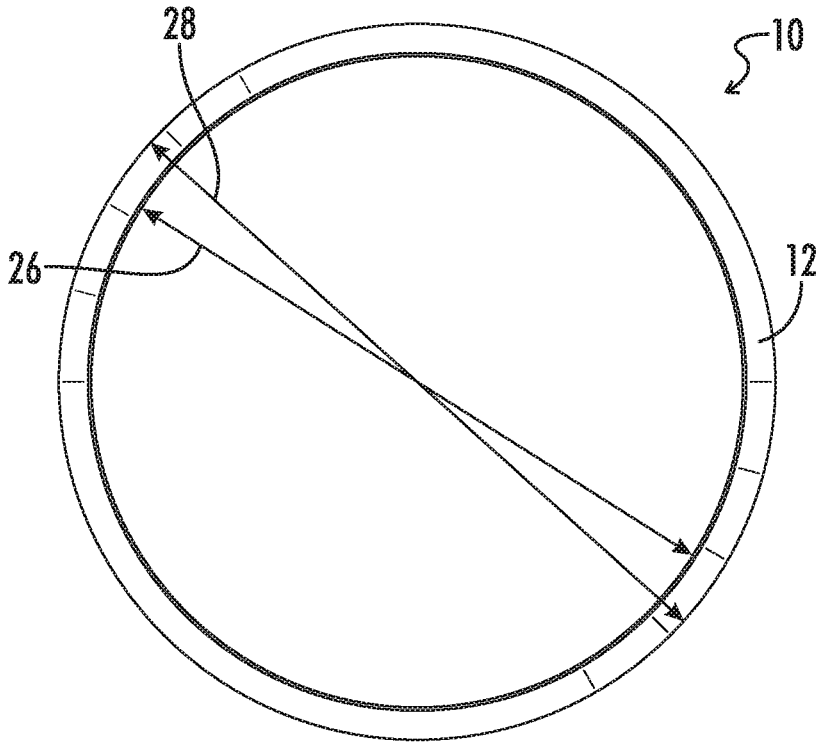
FIG. 3 is a side elevation view of the ring shaped base member of FIG. 1.
Figure 4:
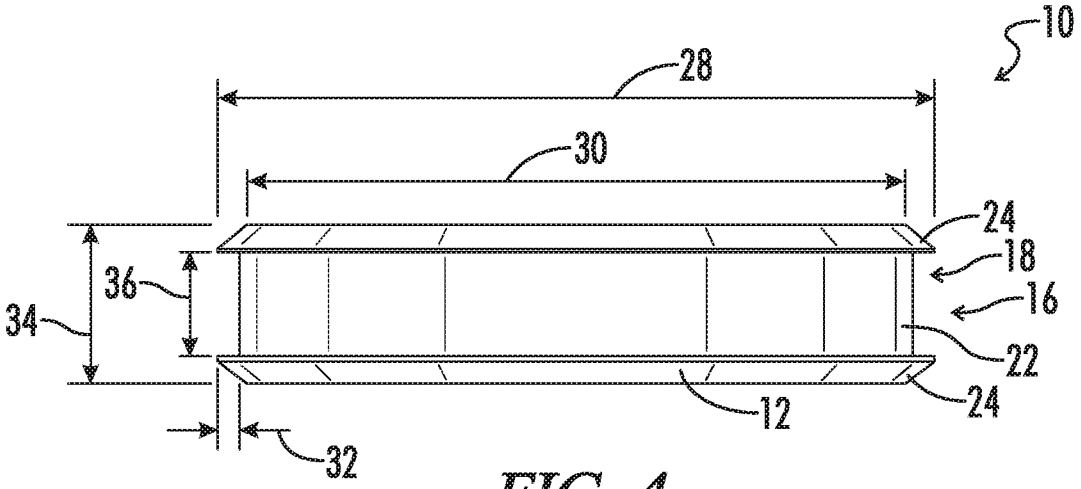
FIG. 4 is a top view of the ring shaped base member of FIG. 1.

Referring to FIGS. 3 and 4, in some embodiments, the circumferential channel 18 can be defined on an exterior side 16 of the ring shaped base member and extend annularly around the entire exterior side 16 of the ring shaped base member 12. The circumferential channel 18 can be formed in the ring shaped base member 12 by various manufacturing methods, including but not limited to debossing, milling, injection molding, lathing, etc. The circumferential channel 18 can include a channel floor 22 and two side edges 24 extending adjacent opposing sides of the circumferential channel 18 toward the exterior side 16 of the ring shaped base member 12. The circumferential channel 18 can be defined between the two side edges 24. In some embodiments, the two side edges 24 can be beveled edges or angled edges such that an exterior of the device 10 when the resilient band 20 is positioned in the circumferential channel 18 can have a generally rounded or concave shape. In other embodiments, the side edges 24 can have a substantially rectangular or square shape.

Figure 5:
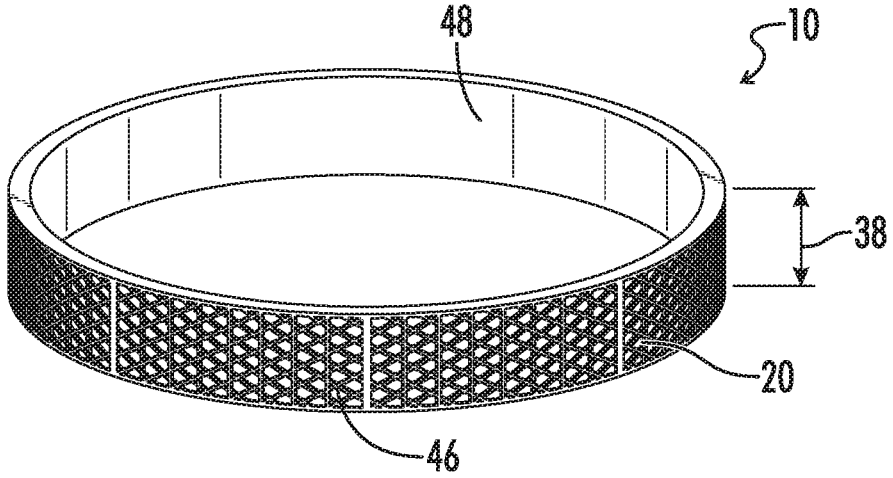
FIG. 5 is a perspective view of the resilient decorative band of FIG. 1.
Figure 6:
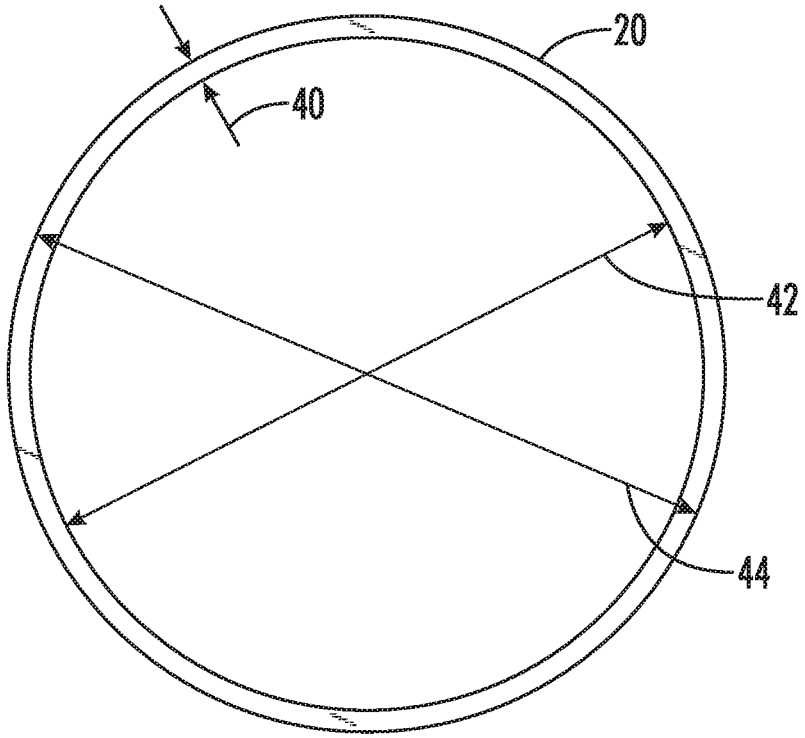
FIG. 6 is a side elevation view of the resilient decorative band of FIG. 1
Figure 7:
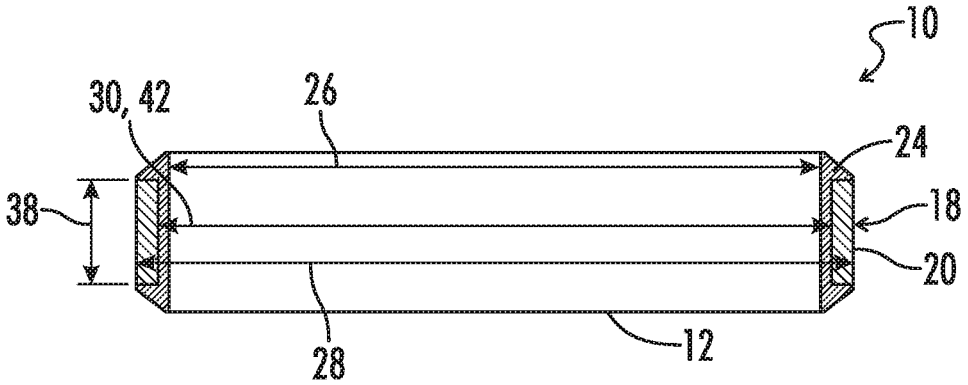
FIG. 7 is a top cross sectional view of the device of FIG. 1.
Figure 8:
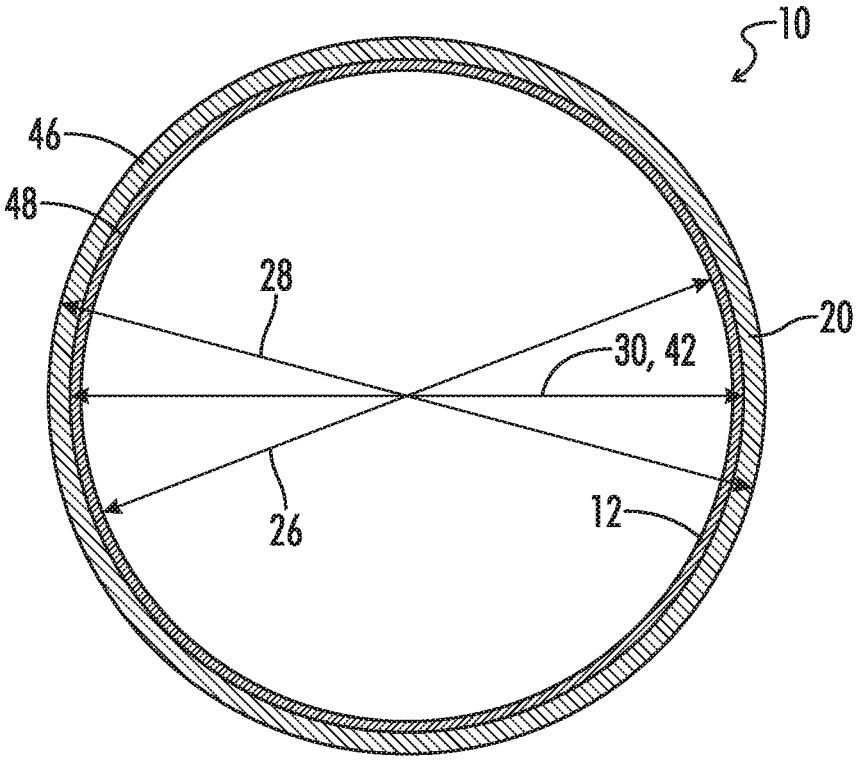
FIG. 8 is a side cross sectional view of the device of FIG. 1.

The ring shaped base member 12 can have a relaxed base member inner diameter 26, a relaxed base member outer diameter 28, and a relaxed floor diameter 30. The difference between the relaxed base member outer diameter 28 and the relaxed floor diameter 30 can define the channel depth 32. The relaxed base member inner diameter 26 can be sized to allow the ring shaped base member 12 and the device 10 to be suitable for use as various types of jewelry, including but not limited to rings, bracelets, earrings, ankle bracelets, watches, necklaces, etc. The ring shaped base member 12 can also have an overall width 34 and a channel width 36, the channel width 36 measured between the side edges 24. The resilient band 20 can also have a relaxed band width 38 and a relaxed band thickness 40, as shown in FIGS. 5-6.

In some embodiments, as shown in FIGS. 4-8, the relaxed band thickness 40 can be substantially equal to the channel depth 32, such that when the resilient decorative band 20 is positioned within the circumferential channel 18, the resilient band 20 can be flush with the exterior side 16 of the ring shaped base member 12, or the outer ends of the side edges 24, such that the resilient band 20 and the ring shaped base member 12 form a flat or flush surface. Such an orientation can allow the ring shaped base member 12 and the resilient band 20 to have the appearance of a continuous, integral jewelry device.

In some embodiments, the circumferential channel 18 can have a cross section, and the resilient band 20 can have a corresponding or congruent cross section, such that when the resilient band 20 is positioned in the circumferential channel 18, the resilient band 20 can generally fill the circumferential channel 18. In some embodiments, the ring shaped base member 12 and the resilient band 20 can have congruent rectangular cross sections. In some embodiments, the ring shaped base member 12 and the resilient band 20 can have any suitably shaped congruent cross sections, including but not limited triangular, trapezoidal, circular, or hemispherical shapes.

In some embodiments, the resilient band 20 can have a relaxed band inner diameter 42 and a relaxed band outer diameter 44. In some embodiments, the relaxed band inner diameter 42 can be substantially equal to the relaxed floor diameter 30, such that the resilient band 20 rests against or fits snuggly against the floor 22 of the circumferential channel 18 when the resilient band 20 is positioned in the circumferential channel 18. The resilient band 20 and the ring shaped base member 12 can be made from materials in some embodiments that can produce friction between the resilient band 20 and the ring shaped base member 12, which can help prevent the resilient band 20 from moving within the circumferential channel 18. In other embodiments, the resilient band 20 and the ring shaped base member 12 can be made from slick or low friction materials such that the resilient band 20 can move or spin within the circumferential channel 18.

In other embodiments, the relaxed band inner diameter 42 can be slightly smaller than the relaxed floor diameter 30 such that when the resilient band 20 is positioned in the circumferential channel 18, the resilient band 20 is maintained in tension and is biased in a radially inward direction which produces an interference fit between the ring shaped base member 12 and the resilient band 20. In other embodiments, the relaxed band inner diameter 42 can be greater than the relaxed floor diameter 30, but less than the relaxed base member outer diameter 28, such that the resilient band 20 is loosely retained in the circumferential channel 18 but can move freely within the circumferential channel 18.

Referring again to FIG. 5-8, in some embodiments, the resilient band 20 can have a first circumferential surface 46 and a second circumferential surface 48 positioned opposite one another on the resilient band 20. A circumferential side is a side of the resilient decorative band 20 that either faces radially inward or radially outward on the resilient decorative band 20. In some embodiments, the first circumferential surface 46 can be a textured or gradient surface. The first circumferential surface 46 can have one or more etched, molded, embossed, or raised patterns or designs. The second circumferential surface 48 can be a smooth surface, thus providing a different aesthetic between the first and second circumferential surfaces. In some embodiments, both the first and second circumferential surfaces 46 and 48 can be textured, and in other embodiments, both the first and second circumferential surfaces 46 and 48 can be smoothed surfaces. However, the first and second circumferential surfaces 46 and 48 can have different designs, colors, patterns, emblems, etc. to produce overall different aesthetic appearances. In some embodiments, the first circumferential 46 can be an outer circumferential surface that is viewable when the resilient band 20 is positioned in the circumferential channel 18, while the second circumferential surface 48 can be positioned against the floor of the circumferential channel 18.

In some embodiments, the resilient band 20 can be twistable into itself in an "inside-out" fashion such that the inner and outer orientations of the first and second circumferential surfaces 46 and 48 can be reversible. The reversibility of the resilient band 20 can allow either the first circumferential surface 46 or the second circumferential surface 48 to be visible when the resilient band 20 is positioned within the circumferential channel 18 such that a single resilient band 20 can provide two aesthetic orientations for the jewelry device 10. The ring shaped base member 12 and the resilient band 20 can also be worn separate from one another. The resilient band 20 can come in various designs, colors, emblems, shapes, etc. allowing the resilient bands 20 to be sold separately from the ring shaped base member 12, such that a user can personalize or customize the look of the jewelry device 10 with different resilient bands 20, each band 20 offering multiple designs.

In this manner, the jewelry device of the present disclosure can allow a user to readily interchange or customize the jewelry device with a wide range of wearable styles by either reversing the resilient band 20 on the device or interchanging the band 20 with a new resilient band 20. Because each band can offer multiple designs for the jewelry device, a wide variety of jewelry designs can be achieved with fewer jewelry pieces than in conventional single design jewelry. The resilient bands can also be easily interchanged, thus allowing for easier customization of the jewelry device when compared to conventional trinket or attachment type jewelry. The ring shaped base member, though, may be provided in a single (or limited) number of designs to help simplify the design, manufacture, and distribution of the jewelry device.

Another aspect of the present invention is a method of assembling a jewelry device including the steps of providing a ring shaped base member with an exterior side and a circumferential channel defined in the exterior side; providing a resilient band; and stretching the resilient band over the ring shaped based member to position and retain the resilient band within the circumferential channel. The method can further include the steps of removing the resilient band from the circumferential channel; twisting the resilient band into itself such that an interior surface of the resilient band is moved to an oriented facing outward on the resilient band; and again stretching the resilient band over the ring shaped based member to position and retain the resilient band within the circumferential channel.

Thus, although there have been described particular embodiments of the present invention of a new and useful JEWELRY DEVICE WITH INTERCHANGEABLE DECORATIVE PIECE, it is not intended that such references be construed as limitations upon the scope of this invention.

What is claimed is:

1. A wearable jewelry device comprising:

a continuous ring shaped base member including an interior side, an exterior side, and a circumferential channel defined in the exterior side, the channel having a depth and extending annularly around a circumference of the exterior side of the base member; and a continuous annular decorative band removably receivable within the channel of the base member wherein the decorative band has a thickness that is substantially equal to the depth of the channel such that the decorative band is flush with the exterior side of the base member when the decorative band is received within the channel; and wherein the base member and the decorative band are formed from a resilient material.

2. The wearable jewelry device of claim 1, further comprising outer beveled edges defined on the exterior side of the base member adjacent the channel.

3. The wearable jewelry device of claim 1, wherein the channel has a rectangular cross section, and the decorative band has a corresponding rectangular cross section such that the decorative band fills the channel when the band is received in the channel.

4. The wearable jewelry device of claim 1, wherein:

the decorative band has a first circumferential side and a second circumferential side;

the first circumferential side has a textured surface; and the second circumferential side has a smooth surface.

5. The wearable jewelry device of claim 4, wherein the decorative band is twistable into itself to selectively alternate each of the first and second circumferential sides between an inner and an outer orientation on the decorative band.

6. The wearable jewelry device of claim 1, wherein:

the channel has a relaxed floor diameter;

the decorative band has a relaxed inner diameter; and the relaxed floor diameter of the channel is substantially equal to the relaxed inner diameter of the decorative band such that the decorative band rests against a floor of the channel when the decorative band is received in the channel.

7. The wearable jewelry device of claim 1, wherein:

the channel has a relaxed floor diameter;

the resilient band has a relaxed inner diameter; and the relaxed inner diameter of the decorative band is less than the relaxed floor diameter of the channel such that the decorative band frictionally engages the base member in an interference fit when the decorative band is received in the channel.

8. The wearable jewelry device of claim 1, wherein the decorative band is stretchable over the exterior side of the base member to be positioned in and removed from the channel of the base member.

* * * * *